US007654223B2

(12) United States Patent
Kim et al.

(10) Patent No.: US 7,654,223 B2
(45) Date of Patent: Feb. 2, 2010

(54) COLD SPRAY APPARATUS HAVING POWDER PREHEATING DEVICE

(75) Inventors: Hyung-Jun Kim, Pohang (KR); Young-Gak Kweon, Pohang (KR)

(73) Assignee: Research Institute of Industrial Science & Technology (KR)

( * ) Notice: Subject to any disclaimer, the term of this patent is extended or adjusted under 35 U.S.C. 154(b) by 483 days.

(21) Appl. No.: 10/583,688

(22) PCT Filed: Dec. 22, 2004

(86) PCT No.: PCT/KR2004/003395

§ 371 (c)(1),
(2), (4) Date: Jun. 20, 2006

(87) PCT Pub. No.: WO2005/061116

PCT Pub. Date: Jul. 7, 2005

(65) Prior Publication Data

US 2007/0137560 A1 Jun. 21, 2007

(30) Foreign Application Priority Data

Dec. 24, 2003 (KR) ..... 10-2003-0096983

(51) Int. Cl.
*B05C 11/00* (2006.01)
*B05C 19/00* (2006.01)
*B05B 7/16* (2006.01)

(52) U.S. Cl. ..... 118/667; 118/308; 118/302; 239/135

(58) Field of Classification Search ..... 118/308, 118/309, 302, 666, 667; 239/594, 596, 600, 239/398–434.5, 13–138; 427/456, 446, 140, 427/142, 180, 205, 422, 448, 455; 419/2, 419/9, 247; 417/197
See application file for complete search history.

(56) References Cited

U.S. PATENT DOCUMENTS 5,302,414 A * 4/1994 Alkhimov et al. ..... 427/192

(Continued)

FOREIGN PATENT DOCUMENTS

JP 2000202331 A 7/2000

(Continued)

*Primary Examiner*—Yewebdar T Tadesse
(74) *Attorney, Agent, or Firm*—The Webb Law Firm

(57) ABSTRACT

A cold spray apparatus having a powder preheating device, capable of obtaining high deposition rate and excellent coating layer under the same spray processing conditions by preheating coating powder before a coating process. Also, a manufacturing method of nano-structured super-high hardness WC—Co coating having high abrasive wear resistance and fracture toughness obtained by spraying WC—Co powder using the cold spray apparatus. In the cold spray apparatus, a gas controller controls gas supply amount of main gas and residual gas (gas that is not supplied toward the main gas), and a gas heater heats the main gas supplied under the control of the gas controller. A powder feeder receives the residual gas under the control of the gas controller and supplies a coating powder together with the residual gas. A powder preheating device preheats the coating powder supplied from the powder feeder, and a mixing chamber mixes the heated main gas with the preheated coating powder. A temperature controller adjusts temperature by controlling the powder preheating device and the gas heater, and the coating powder mixed in the mixing chamber is sprayed through a nozzle.

2 Claims, 3 Drawing Sheets

U.S. PATENT DOCUMENTS

| | | | |
|---|---|---|---|
| 5,459,811 | A | 10/1995 | Glovan et al. |
| 5,855,965 | A | 1/1999 | Molerus et al. |
| 6,110,544 | A | 8/2000 | Yang et al. |
| 6,139,913 | A | 10/2000 | Van Steenkiste et al. |
| 6,283,386 | B1 | 9/2001 | Van Steenkiste et al. |
| 6,365,222 | B1 | 4/2002 | Wagner et al. |
| 6,444,259 | B1 | 9/2002 | Subramanian et al. |
| 6,464,933 | B1 | 10/2002 | Popoola et al. |
| 6,491,208 | B2 | 12/2002 | James et al. |
| 6,502,767 | B2 | 1/2003 | Kay et al. |
| 6,592,935 | B2 | 7/2003 | Leonardi et al. |
| 6,722,584 | B2 | 4/2004 | Kay et al. |
| 6,773,763 | B2 | 8/2004 | Leonardi et al. |
| 6,808,755 | B2 * | 10/2004 | Miyamoto et al. ..... 427/446 |
| 2002/1007398 | | 6/2002 | Shaikh et al. |
| 2002/0182314 | A1 | 12/2002 | Leonardi et al. |

FOREIGN PATENT DOCUMENTS

| | | | |
|---|---|---|---|
| JP | 2002059037 | A | 2/2002 |
| KR | 99-007365 | A | 1/1999 |
| KR | 10-0245231 | B1 | 2/2000 |

* cited by examiner

Particles: WC(dark grey); $W_2C$(light grey); W(light)

COLD SPRAY APPARATUS HAVING POWDER PREHEATING DEVICE

BACKGROUND

1. Field of the Invention

The present invention relates to a cold spray apparatus having a powder preheating device. In more particularly, the present invention relates to a cold spray apparatus having a powder preheating device, capable of obtaining high deposition rate and excellent coating layer under the same spray processing conditions by preheating coating powder before a coating process.

2. Prior Art

A thermal spray coating method is widely used to coat material to a substrate. In the thermal spray coating method, a substrate that is a parent material is roughened by a blasting process and is coated by a mechanical bonding. That is, a powder is melted by several heat sources, such as electric arc and plasma, and then is sprayed on the substrate at high velocity. In this manner, the powder is coated on the substrate.

Such a thermal spray coating method can coat almost all kinds of material. Also, substrate temperature is increased slightly and a relatively thick coating is possible at a short time. For these reasons, the thermal spray coating method has been widely used in many industrial fields.

However, an original structure of the coating powder may be changed due to the melting of the coating material. Specifically, in the case of special structures like a nano or amorphous structure, material is melted even if raw material has nano or amorphous structure. Thus, after the coating, the resultant structure can hardly hold the original nano or amorphous structure.

When a material such as nano-structured WC—Co is sprayed at high velocity, a large area of the powder is exposed to the heat source and therefore WC is easily decomposed into a vulnerable carbide such as $W_2C$, $W_3Co_3C$ or $W_6Co_6C$. Thus, the thermal spray coating method has a disadvantage that can hardly obtain an excellent coating layer.

In order to solve the problems of the thermal spray coating method, a cold spray technique capable of coating powders at a low temperature has been developed. In the cold spray technique, powder particles having a size of about 1-50 μm are accelerated to a velocity of 300-1200 m/sec, which exceeds a threshold velocity at which a coating material can be coated on a substrate, by using high pressure gases, such as nitrogen, helium and air. The particles strike the target surface, the kinetic energy of the particles is transformed into plastic deformation of the particles, and a bond is formed between the particles and the target surface.

Since the cold spray technique coats the particles in solid state without melting them, it can solve somewhat the problems of the thermal spray coating method. In addition, since there is no residual tensile stress caused by solidification stress, a thick coating is possible. Therefore, the cold spray technique can be applied to "near net shaping" process.

The cold spray technique is disclosed in U.S. Pat. Nos. 6,365,222 B1, 6,491,208 B2, 6,139,913 and 6,283,386, and U.S. Pat. Pub. Nos. 2001/0042508 A1, 2002/0033135 A1, U.S. Pat. No. 6,502,767 B2, 2002/0073982 A1, 2002/0102360 A1, U.S. Pat. No. 6,444,259 B1, 2002/0182311 A1, 2002/0182313 A1, 2002/0182314 A1, etc.

U.S. Pat. No. 6,365,222 B1 discloses a process of repairing components using a cold spray technique, and U.S. Pat. No. 6,491,208 B2 discloses a process of repairing turbine blade. Also, U.S. Pat. Nos. 6,139,913 and 6,283,368 disclose a nozzle that can accelerate gas to high velocity in the range of 1000 m/sec or more. Those patents can be applied to powder particles having size of 50 μm or more. In addition, those patents discloses a cross-sectional area ratio of a main gas passage to an injection tube in a mixing chamber for mixing the accelerating gas and the coating particles.

U.S. Pat. Pub. Nos. 2001/0042508 A1 and 2002/0033135 A1 and U.S. Pat. No. 6,502,767 B2 disclose a method of easily disassembling a cold spray nozzle. A material for main feed tube and a maximum preheating temperature (700° C.) are described in those publications and patent.

U.S. Pat. Pub. No. 2002/0073933 A1 discloses a method of applying a cold spray in coating a cylinder inner wall of a car engine block.

U.S. Pat. Pub. No. 2002/0102360 A1 and U.S. Pat. No. 6,444,259 B1 disclose a thermal barrier coating and an applying method thereof.

U.S. Pat. Pub. Nos. 2002/0182311 A1, 2002/0182313 A1 and 2002/0182314 A1 disclose a method of manufacturing electric machines using kinetic spray.

The above-described cold spray techniques are useful in various application fields, but have problems to be solved.

First, there is a limit to usable materials because solid materials are used in the cold spray techniques. Specifically, ceramic is very difficult to use in the cold spray technique, while pure copper, nickel or aluminum is widely used because of its high ductility.

Second, even the widely used materials must be sprayed at high velocity of more than threshold velocity so as to obtain an excellent coating characteristic. Otherwise, the yield may be degraded due to a low deposition rate.

Cermet materials, such as WC—Co, have high abrasive wear resistance and thus are widely used for industry. However, since the cermet materials have bad coating characteristic by cold spray, they are mainly used in the thermal spray coating technique. That is, the cermet materials are difficult to use in the cold spray technique.

The increase in the velocity of the accelerating gas can be achieved by increasing pressure of a gas supply unit. However, this method requires a large amount of gas so as to increase the gas pressure. Consequently, a large amount of gas is used so that economic efficiency gets worse.

In order to solve that problem, the accelerating gas is generally heated to about 400-600° C. so as to increase the gas velocity without increasing the pressure of the gas supply unit in the cold spray apparatus. The method is effective in increasing the velocity of the accelerating gas because specific volume and pressure of gas can be increased and the adiabatic expansion effect at the nozzle can be obtained by this method.

However, if the method alone is used, it is difficult to obtain a satisfactory deposition rate, especially in the coating of cermet materials. Accordingly, the gas heater must heat the gas more higher so as to increase gas temperature, resulting in increase of the power consumption. In addition, a lifetime of a tube in the gas heater is shortened and thus there is a limit in the increase of temperature.

SUMMARY OF THE INVENTION

Accordingly, the present invention is directed to substantially obviate one or more problems due to limitations and disadvantages of the related art.

An object of the present invention is to provide a cold spray apparatus having a powder preheating device, capable of obtaining high deposition rate and excellent coating layer under the same spray processing conditions by preheating coating powder before a coating process.

To achieve the above object and other advantages of the present invention, a cold spray apparatus includes a gas controller for controlling gas supply amount of main gas and residual gas (gas that is not supplied as the main gas), a gas heater for heating the main gas supplied under the control of the gas controller, a powder feeder for receiving the residual gas under the control of the gas controller and supplying a coating powder together with the residual gas, a powder preheating device for preheating the coating powder supplied from the powder feeder, a mixing chamber for mixing the heated main gas with the preheated coating powder, a temperature controller for adjusting temperature by controlling the powder preheating device and the gas heater, and a nozzle for spraying the coating powder mixed in the mixing chamber.

The powder preheating device may include, a housing, a heater mounted on the housing to perform resistance heating, and a powder transfer pipe formed within the housing in a screw shape in order for fluid communication between the powder feeder and the mixing chamber, the powder transfer pipe transferring the coating powder.

The powder transfer pipe may be made of stainless steel.

According to the present invention, a cold spray apparatus having a powder preheating device can obtain high deposition rate and excellent coating layer under the same spray processing conditions by preheating coating powder before a coating process.

Also, the present invention can provide nano-structured super-high hardness WC—Co coating having high abrasive wear resistance and fracture toughness.

BRIEF DISCRIPTION OF THE DRAWINGS

DISCRIPTION OF PREFERRED EMBODIMENTS

Reference will now be made in detail to the preferred embodiments of the present invention, examples of which are illustrated in the accompanying drawings.

Figure 1:
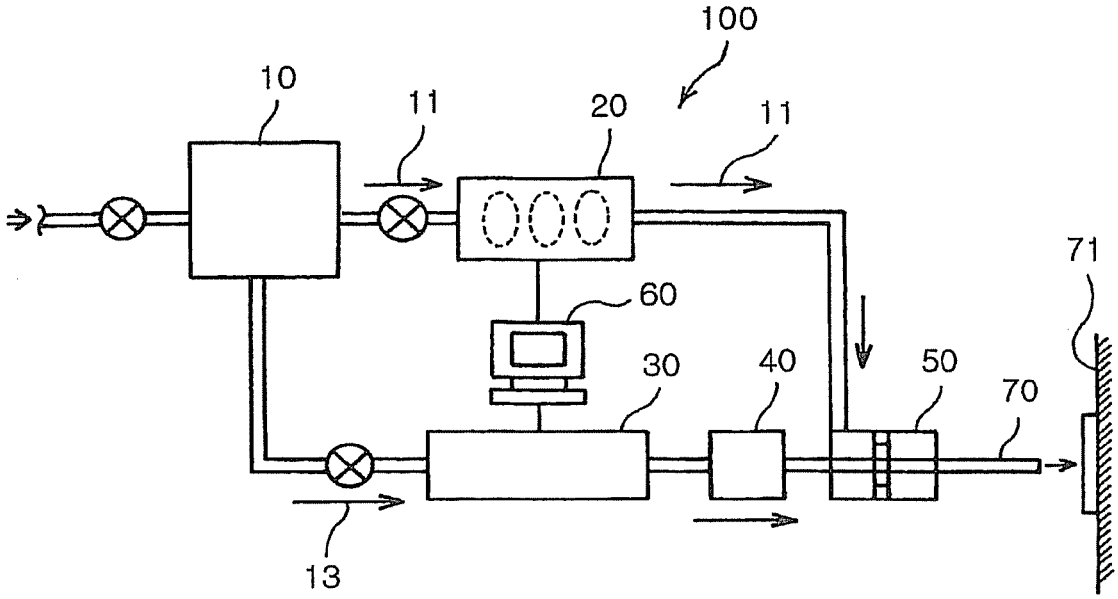
FIG. 1 is a schematic view of a cold spray apparatus having a powder preheating device according to a preferred embodiment of the present invention.
Figure 2:
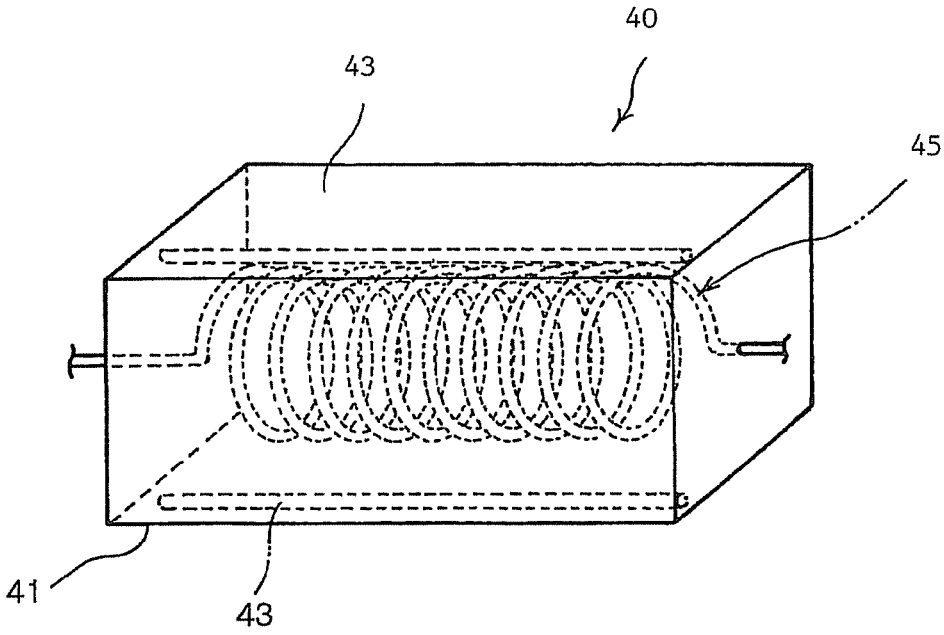
FIG. 2 is a perspective view of the powder preheating device shown in FIG. 1.

FIG. 1 is a schematic view of a cold spray apparatus having a powder preheating device according to a preferred embodiment of the present invention, and FIG. 2 is a perspective view of the powder preheating device shown in FIG. 1.

Referring to FIGS. 1 and 2, a cold spray apparatus 100 having a powder preheating device according to the present invention includes a gas controller 10, a gas heater 20, a powder feeder 30, a powder preheating device 40, a mixing chamber 50, a temperature controller, and nozzle 70. In the cold spray apparatus 100, the gas controller 10 controls gas supply amount of main gas 11 and residual gas 13 (gas that is not supplied toward the main gas), and the gas heater 20 heats the main gas 11 supplied under the control of the gas controller 10. The residual gas 13 is supplied to the powder feeder 30 under the control of the gas controller 10. The powder feeder 30 supplies a coating powder together with the residual gas 13. The powder preheating device 40 preheats the coating powder supplied from the powder feeder 30, and the mixing chamber 50 mixes the heated main gas with the preheated coating powder. The temperature controller 60 adjusts temperature by controlling the powder preheating device 40 and the gas heater 20. The nozzle 70 sprays the coating powder mixed in the mixing chamber 50.

The gas controller 10 controls the gas supply amount. In more detail, the gas controller 10 supplies the main gas 11 to the gas heater and also supplies the residual gas (the gas that is not supplied to the gas heater) to the powder feeder 30.

The gas heater 20 heats the main gas 11 supplied from the gas controller 10. The heated main gas increases pressure compensation due to volume expansion and also increases adiabatic expansion due to high internal energy when the main gas is sprayed through the nozzle 70.

The powder feeder 30 receives the residual gas from the gas controller 10 and carries the powder by using the residual gas. Then, the powder feeder 30 supplies the powder and the residual gas to the powder preheating device 40.

The powder preheating device 40 is a most characteristic element of the present invention. The powder preheating device 40 can increase the yield of the powder that is coated under the same gas supply conditions as the conventional cold spray apparatus. In addition, the powder preheating device 40 makes it easy to coat material such as WC—Co cermet, which has poor coating characteristic so that the coating of the WC—Co cermet is difficult in the conventional cold spray apparatus.

Referring to FIGS. 1 and 2, the powder preheating device 40 is installed between the powder feeder 30 and the mixing chamber 50 and includes a housing 41, a heater 43 and a powder transfer pipe 45. The heater 43 is mounted on the housing 41 to perform resistance heating. The powder transfer pipe 45 is formed within the housing 41 in a screw shape in order for fluid communication between the powder feeder 30 and the mixing chamber 50. The powder transfer pipe 45 transfers the coating powder.

The heater 43 is used to heat an interior of the housing 41 and is preferably provided with resistance wire. That is, the heater 43 indirectly heats the powder contained in the powder transfer pipe 45, which passes through the interior of the housing 41.

In order to maximize thermal efficiency and space limitation of the powder preheating device 40, it is effective to form the powder transfer pipe 45 in a screw shape. In addition, it is preferable that the screw-shaped powder transfer pipe 45 has five or more turns. The shape of the powder transfer device 45 causes the powder to reside within the interior of the housing 41 for a longer time. Thus, the preheating effect of the coating powder can be increased as much. It is preferable that the powder transfer pipe 45 is made of stainless steel material for corrosion resistance at elevated temperature.

The powder heated in such a powder preheating device has temperature higher than that of the powder sprayed from the conventional cold spray apparatus. In this case, energy of the powder is increased and ductility and fracture toughness are also improved, so that the coating characteristic is remarkably enhanced.

Meanwhile, the powder preheating device 40 and the gas heater 20 must be controlled within appropriate temperature range, considering the stability of both the powder preheating device 40 and the gas heater 20 and the coating characteristic of the powder. For this purpose, the temperature controller 60 is provided. The temperature controller 60 may be a computer system.

The coating powder preheated through the powder preheating device 40 is transferred to the mixing chamber 50. Then, the preheated coating powder is mixed with the main gas, which is heated and then supplied from the gas heater 20. Consequently, a gas to powder ratio suitable for the coating is formed.

The mixture of the gas and the powder is sprayed from the mixing chamber 50 to a coating target 71 through the nozzle 70. In this manner, the coating is performed.

As described above, compared with the conventional cold spray apparatus, the cold spray apparatus having the powder preheating device according to the present invention has the excellent coating characteristic. The reasons are as follows. The cold spray process is achieved by the stacking due to plastic deformation of the material. Therefore, as the ductility of the coating material is increased, the deposition rate and the coating characteristic are improved. If temperature is increased, the ductility of metal is increased. At this point, the spray apparatus having the powder preheating device according to the present invention can effectively increase the powder temperature.

Hereinafter, a method for using the cold spray device will be described in detail with an example of nano-structured super-high hardness WC—Co coating.

The nano-structured WC—Co powder is a powder that contains nano-sized WC (tungsten carbide), which is distributed finely and uniformly within Co-based structure. If the coating layer is made of such a nano-structured WC—Co powder, it has a very high abrasive, wear resistance. Thus, it can be used as a super-high hardness coating layer.

However, the nano-structured WC—Co powder has a high reactivity due to its very high surface area. Therefore, if the coating is performed by the thermal spray coating method, WC is easily decomposed into a vulnerable carbide such as $W_2C$, $W_3Co_3C$ or $W_6Co_6C$, such that it is difficult to obtain an excellent coating layer. Even if the typical cold spray process is used for overcoming those drawbacks, the threshold velocity for the excellent coating layer is very high such that this method is inappropriate.

The present inventors made many attempts to solve the problems. As a result, the present inventors know that the coating characteristic can be improved much more when total energy of particles sprayed during the cold spray is increased.

The reasons are as follows. If only the velocity of the typical cold spray accelerating gas is used, it is difficult to reach the threshold velocity at which WC—Co cermet can be coated. Also, a method of increasing the velocity more than the threshold velocity is practically impossible. Therefore, another energy is required for compensating for kinetic energy due to the velocity. In addition, it is necessary for the ductility to increase so high as to absorb impact energy, which is generated when the sprayed particles collide with the coating substrate.

A method that can satisfy those conditions is to increase temperature of the particles. That is, if the temperature of the particles is increased, heat energy of the particles is increased and thus energy for bonding the post-collision substrate or other powder particles is increased. Also, the ductility of the Co-based structure can be improved depending on characteristic of metal.

On the basis of the above reason, a manufacturing method of the super-high hardness nano WC—Co coating layer will be described below.

First, size of WC—Co cermet in which nano-sized WC is uniformly distributed within Co-based structure needs to be limited to the range of 1-50 μm. The particles can be most easily sprayed within the size of 1-50 μm during the cold spray. In addition, it is preferable that the Co is contained more than 12 wt % in the WC—Co powder to guarantee toughness of the powder.

Next, carrier gases that serve to carry the coating powder need to be supplied. The carrier gases are supplied through two paths. One is the main gas that supplies kinetic energy to the coating powder, and the other is the residual gas that is required when carrying the coating powder to a location where the coating powder and the main gas will be mixed.

Among the gases, the main gas needs to be heated by the gas heater or the like so as to make the main gas have high velocity during the spray process. Therefore, the heating process is necessary before the main gas is mixed with the powder.

In addition, the residual gas carries the powder contained in a separate powder repository (the gas feeder 30) to the mixing location.

The heated powder, the residual gas and the main gas are mixed within the mixing chamber 50 and are sprayed at high velocity. Then, due to the energy, the coating powder is bonded with the coating substrate or the previously stacked powder to thereby form the coating layer.

At this point, it is preferable that nitrogen or helium is used as the main gas and the residual gas so as to minimize the reaction with the nano-structured WC—Co powder, having high reactivity.

In addition, the powder needs to be heated to 100° C. or higher so as to supply the heat energy to the powder. As the powder preheating temperature is increased, the coating characteristic gets better. However, the time necessary for the preheating and the power consumption are increased such that the economic efficiency get worse. For this reason, the powder preheating temperature is limited to maximum 600° C.

While the present invention will be particularly shown and described with reference to preferred embodiments thereof, it will be understood by those skilled in the art that various changes may be made without departing from the spirit and scope of the invention.

Embodiment 1

Cold Spray Process of Nickel Powder

A spray coating of nickel (Ni) powder was performed under conditions of Table 1 so as to observe the effects of the cold spray apparatus having the powder preheating device according to the present invention.

TABLE 1

| Item | Condition | Remark |
|---|---|---|
| Powder | Nickel | 99%, 10-45 μm |
| Coating substrate | SUS 304 | 5 mm thick |
| Distance between nozzle and substrate | 15 mm | |
| Gas | Nitrogen | |
| Gas pressure | 40 kg/cm$^2$ | |
| Gas temperature | 700° C. | |
| Feeding rate of powder | 50 rpm (5 kg/hr) | |
| Moving speed of nozzle | 10 mm/sec | |
| Number of coating pass | 2 | |

The cold spray process was performed under the conditions of Table 1 while changing the powder preheating conditions as shown in Table 2 below.

TABLE 2

| Classification | Powder preheating temperature (° C.) | Deposition rate (%) | Coating thickness (mm) | Porosity (%) |
|---|---|---|---|---|
| Comparative example 1 | None | 16 | 0.51 | 5 |
| Inventive example 1 | 150° C. | 32 | 1.01 | 2 |
| Inventive example 2 | 250° C. | 59 | 1.83 | 2 |
| Inventive example 3 | 400° C. | 89 | 2.77 | 2 |

The coating substrate used in Table 1 was roughened by a blasting process before the coating process.

As can be seen from Table 2, when only the powder preheating conditions are changed while all other conditions are equal, the deposition rate and the coating thickness are rapidly increased as the powder preheating temperature is increasing. Specifically, the comparative example 1 has the porosity of 5%, which is very higher than those of the inventive examples. Thus, the comparative example 1 is difficult to form a dense coating layer.

Embodiment 2

Review of Cold Spray Conditions of WC—Co Powder

Another embodiment of the cold spray apparatus having the powder preheating device according to the present invention is shown in Tables 3 and 4 below.

TABLE 3

| Item | Inventive Examples 4, 5, 6 | Inventive Example 7 | Remark |
|---|---|---|---|
| Powder | WC-15% Co Particle size: 1-20 μm | WC-12% Co Particle size: 5-45 μm | nano-structure |
| Coating substrate | SUS 304 | SUS 304 | 5 mm thick |
| Distance between nozzle and substrate | 10 mm | 15 mm | |
| Gas | Nitrogen | Helium | |
| Gas pressure | 45 kg/cm$^2$ | 32 kg/cm$^2$ | |
| Gas temperature | 800° C. | 600° C. | |
| Feeding rate of powder | 30 rpm (3 kg/hr) | 30 rpm(3 kg/hr) | |
| Moving speed of nozzle | 10 mm/sec | 10 mm/sec | |
| Number of coating pass | 4 | 4 | |

TABLE 4

| Classification | Powder preheating temperature (° C.) | Coating thickness (mm) | Vickers hardness |
|---|---|---|---|
| Comparative example 2 | None | 0.1 | 1350 |
| Inventive example 4 | 200 | 0.3 | 1470 |
| Inventive example 5 | 300 | 0.35 | 1480 |
| Inventive example 6 | 400 | 0.4 | 1550 |
| Inventive example 7 | 500 | 0.9 | 2050 |

Table 3 shows the conditions when WC-12% Co and WC-15% Co was cold sprayed, and Table 4 shows the result when the cold spray process was performed under the conditions of Table 3, while changing the powder preheating temperature.

As can be seen from Table 4, the cold spray process of the comparative example 2 where no preheating process is performed is inferior to that of the inventive examples in view of both the coating thickness and the Vickers hardness.

Figure 3:
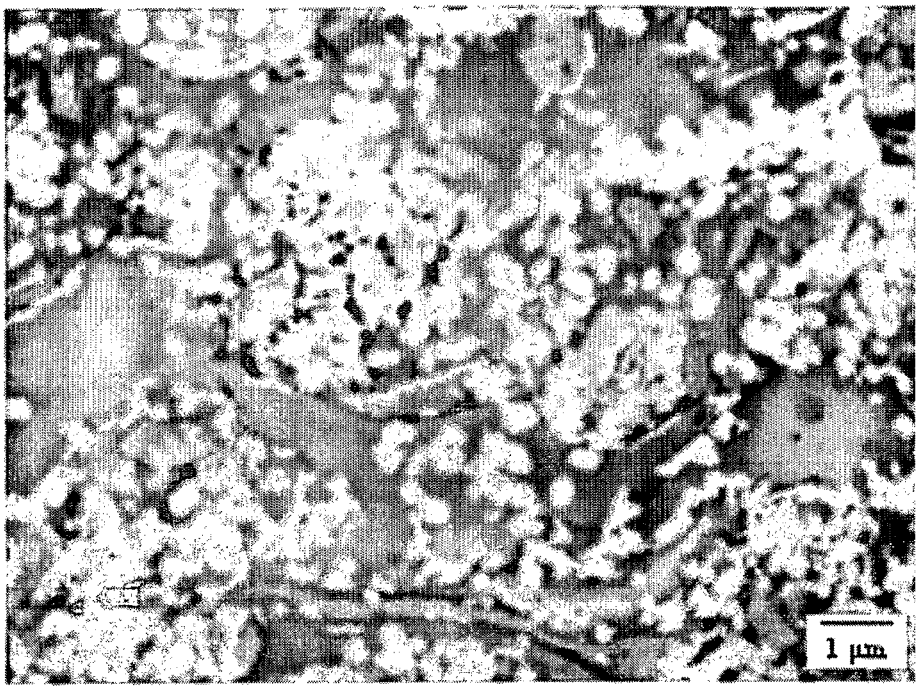
FIG. 3 is a photograph showing a sectional structure of a coating layer, which is formed after an etching by the comparative example 4 of Table 5.
Figure 4:
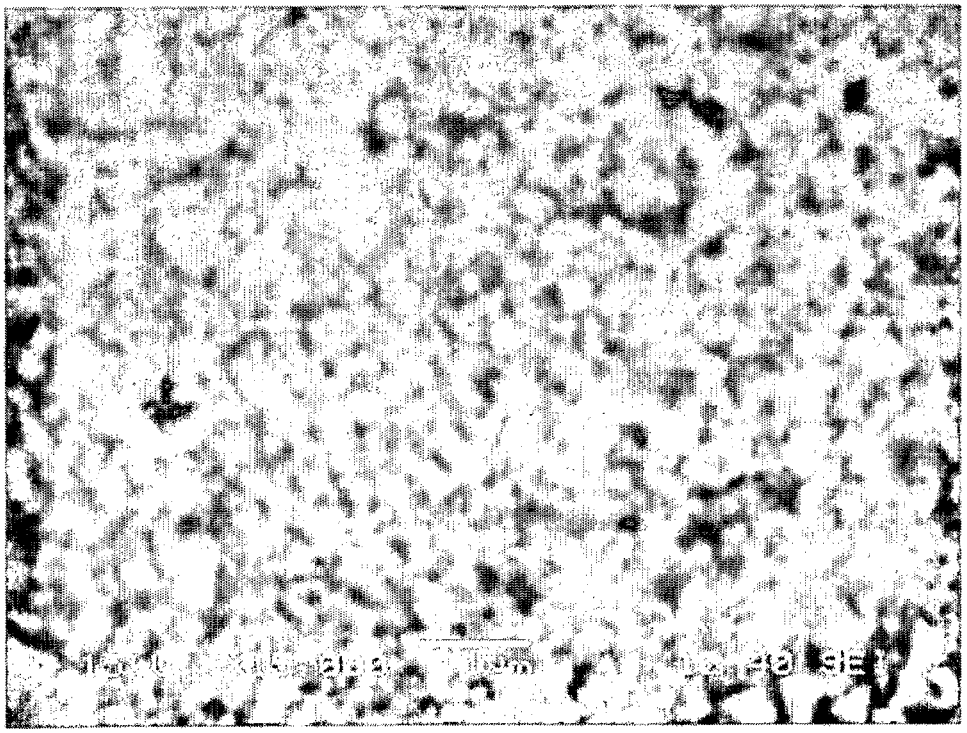
FIG. 4 is a photograph showing a sectional structure of a coating layer, which is formed after an etching by the inventive example 8 of Table 5.

In order to check the test results more thoroughly, the sections of the structures coated by the comparative example 2 and the inventive example 6 were observed by a microscope. Their results are shown in FIGS. 3 and 4. That is, FIG. 3 is a photograph showing the sectional structure of the coating layer, which is formed by the comparative example 2, and FIG. 4 is a photograph showing the sectional structure of the coating layer, which is formed by the inventive example 6. It can be seen that the structure of FIG. 3 is not denser than that of FIG. 4. Also, the structure of FIG. 4 maintains the nano-structure well. Accordingly, the coating layer of the present invention can have the excellent coating thickness and hardness. In addition, unlike the thermal spray coating method, the transformation of the nano-structure does not almost occur.

Embodiment 3

Comparison of the Cold Spray Method with Thermal Spray Coating Method

In order to compare the cold spray method of the present invention with the conventional thermal spray coating method, the test was performed under the conditions of Table 5 below. Other condition to perform cold spray coating is same as that of Table 3 according to the composition of WC—Co.

TABLE 5

| Classification | Powder composition | Particle size of powder (μm) | Powder structure | Coating method | Coating structure | Vickers hardness (Hv) |
|---|---|---|---|---|---|---|
| Comparative example 3 | WC—12%Co | 5-45 | Micro | High speed thermal spray | Micro | 1150 |
| Comparative example 4 | WC—15%Co | 1-20 | Nano | High speed thermal spray | Micro + Nano | 1200 |
| Comparative example 5 | WC—17%Co | 15-45 | Micro | High speed thermal spray | Micro | 950 |
| Inventive example 8 | WC—15%Co | 1-20 | Nano | Cold spray | Nano | 1550 |

TABLE 5-continued

| Classification | Powder composition | Particle size of powder (μm) | Powder structure | Coating method | Coating structure | Vickers hardness (Hv) |
|---|---|---|---|---|---|---|
| Inventive example 9 | WC—12%Co | 5-45 | Nano | Cold spray | Nano | 2050 |

As can be seen from Table 5, in the case of the comparative examples 3 to 5 using the high speed thermal spray method, it is difficult to obtain nano-structured coating layer after the thermal spray process without regard to the composition, particle size and structure of the powder. That is, the comparative example 4 shows the result when 1-20 μm nano-structured particles were thermal sprayed at a high speed. However, the structure of the coating layer was changed very much and thus contains a large number of micro-structures. However, in the case of the inventive examples 8 and 9, it was possible to obtain the excellent nano-structured coating layer. In addition, in the case of the comparative examples 3 to 5, the hardness of the coating layer was generally lower than 1200 Hv. However, in the case of the inventive examples, the hardness of the coating layer was higher than 1500 Hv, in some cases 2000 Hv.

Figure 5:
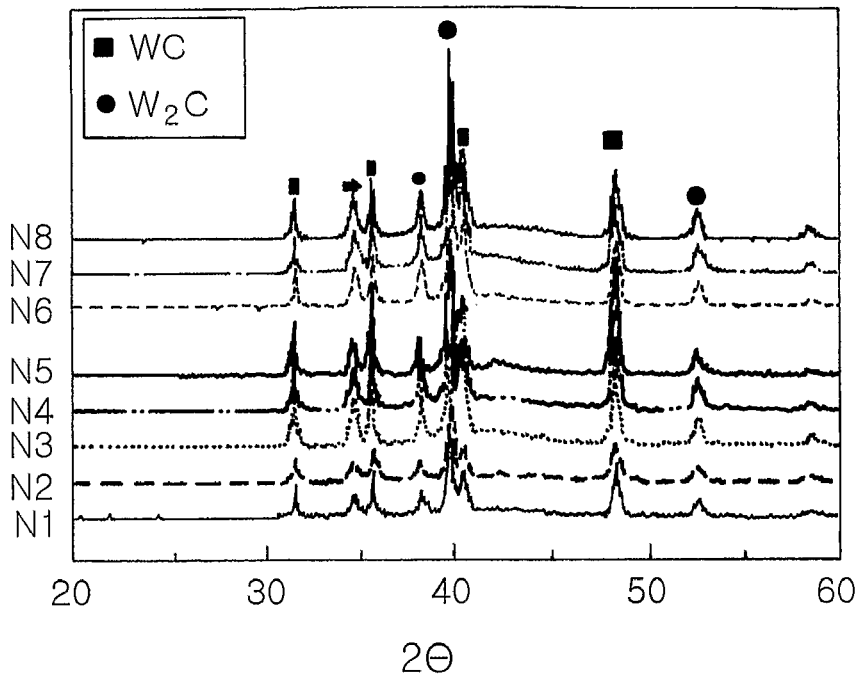
FIG. 5 shows a result of an X-ray diffraction analysis on a coating layer, which is formed by the comparative example 4 of Table 5.

In order to obviously check the difference between the comparative example and the inventive example, an X-ray diffraction analysis was performed on the coating layer. FIG. 5 shows a result of the X-ray diffraction analysis on the coating layer, which is formed by the comparative example 4, and FIG. 6 shows a result of the X-ray diffraction analysis on the coating layer, which is formed by the inventive example 8.

Figure 6:
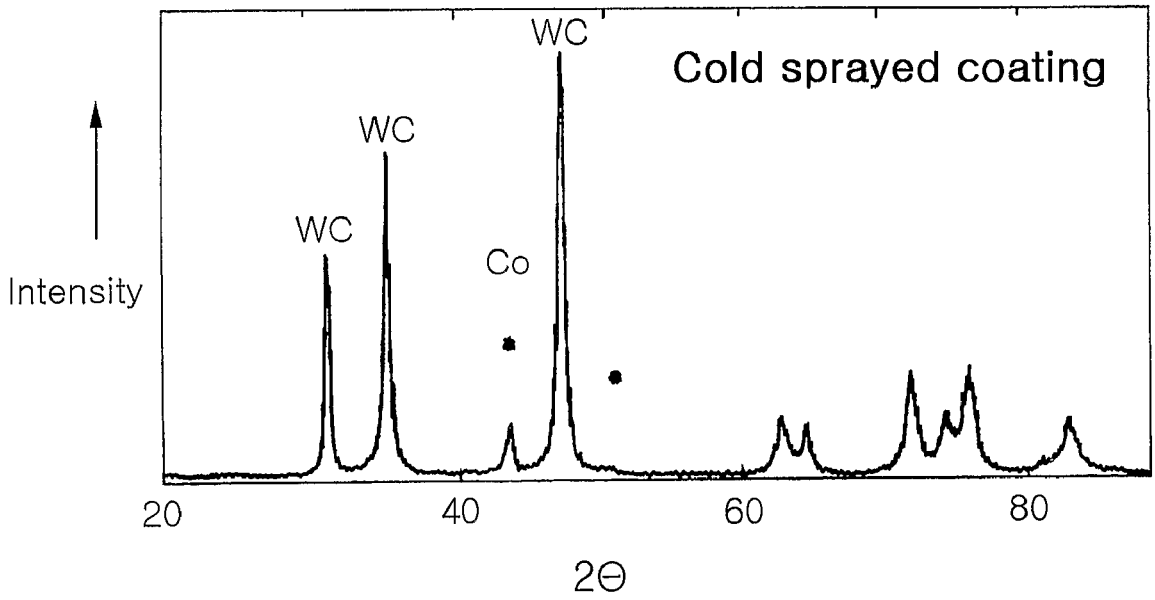
FIG. 6 shows a result of an X-ray diffraction analysis on a coating layer, which is formed by the inventive example 8 of Table 5.

The difference can be obviously seen in FIGS. 5 and 6. That is, referring to FIG. 6, peak positions of WC and Co appear clearly but mid-phase cannot be checked. On the contrary, referring to FIG. 5, both peak of $W_2C$ and Co transformed by the thermal spray and peak of WC contained in the powder reduced. Therefore, it can be seen that the hardness is reduced.

As described above, the effects of the cold spray apparatus having the powder preheating device and the cold spray method of WC—Co powder using the same can be confirmed.

It will be apparent to those skilled in the art that various modifications and variations can be made in the present invention. Thus, it is intended that the present invention covers the modifications and variations of this invention provided they come within the scope of the appended claims and their equivalents.

INDUSTRIAL APPLICABILITY

The present invention can provide the cold spray apparatus and method, that can solve the problem of the conventional thermal spray coating method in which the compound and structure of the particles are transformed so that it is difficult to form the desired coating layer. In addition, the cold spray apparatus and method of the present invention can effectively and economically form the coating layer that can solve the problems of the poor porosity and deposition rate.

The invention claimed is:

1. A cold spray apparatus comprising:

a gas controller for controlling a gas supply amount of main gas and residual gas;

a gas heater for heating the main gas supplied under the control of the gas controller;

a powder feeder for receiving the residual gas under the control of the gas controller and supplying a coating powder together with the residual gas;

a powder preheating device for preheating the coating powder supplied from the powder feeder including a housing, a heater mounted on the housing to perform resistance heating, and a powder transfer pipe formed within the housing in a screw shape in order for fluid communication between the powder feeder and the mixing chamber, the powder transfer pipe transferring the coating powder;

a mixing chamber for mixing the heated main gas with the preheated coating powder;

a temperature controller for adjusting temperature by controlling the powder preheating device and the gas heater; and a nozzle for spraying the coating powder mixed in the mixing chamber.

2. The cold spray apparatus of claim 1, wherein the powder transfer pipe is made of stainless steel.

* * * * *

UNITED STATES PATENT AND TRADEMARK OFFICE

CERTIFICATE OF CORRECTION

PATENT NO. : 7,654,223 B2
APPLICATION NO. : 10/583688
DATED : February 2, 2010
INVENTOR(S) : Kim et al.

It is certified that error appears in the above-identified patent and that said Letters Patent is hereby corrected as shown below:

Face of the Patent, See Item (56) References Cited, U.S. PATENT DOCUMENTS, page 2, Column 2, second to the last U.S. document, "2002/1007398" should read: --2002/10073982--

Column 1, Line 8, "In more particularly" should read -- More particularly --

Column 1, Line 10, "obtaining high" should read -- obtaining a high --

Column 1, Line 11, "and excellent" should read -- and an excellent --

Column 1, Lines 12-13, "preheating coating powder before coating process" should read -- preheating the coating powder before the coating process --

Column 1, Line 16, "material to a substrate" should read -- material on a substrate --

Column 2, Line 3, "patents discloses a" should read -- patents disclose a --

Column 2, Line 26, "of its high ductility" should read -- of their higher ductility --

Column 2, Line 53, "gas more higher" should read -- gas still higher --

Column 2, Lines 53-54, "resulting in increase" should read -- resulting in an increase --

Column 2, Line 54, "a lifetime" should read -- the lifetime --

Column 3, Line 36, "invention." should read -- invention; --

Column 3, Line 38, "FIG. 1." should read -- FIG. 1; --

Column 3, Line 41, "Table 5." should read -- Table 5; --

Column 3, Line 44, "Table 5." should read -- Table 5; --

Signed and Sealed this

Eighth Day of June, 2010

David J. Kappos

David J. Kappos
*Director of the United States Patent and Trademark Office*

Column 3, Line 47, "Table 5." should read -- Table 5; and

Column 3, Line 52, "DISCRIPTION OF THE PREFERRED EMBODIMENTS" should read
-- DETAILED DESCRIPTION OF THE INVENTION --

Column 7, Line 24, "is very higher" should read -- is significantly higher --

Column 7, Line 24, "the comparative example 1 is" should read
-- in comparative example 1 it was --

Column 8, Line 34, "is not denser than" should read -- is less dense than --

Column 8, Line 37, "invention can have the" should read -- invention provides --

Column 8, Lines 39-40, "does not almost occur" should read
-- does not substantially occur --

Column 8, Line 51, "the test was performed under the conditions of Table" should read
-- a test was performed under the conditions set forth in Table --

Column 8, Line 52, "Other condition to perform cold spray coating is" should read
-- Other cold spray coating conditions were the --

Column 8, Line 53, "same as that of Table 3" should read -- same as those of Table 3 --

Column 10, Line 10, DELETE the section heading "INDUSTRIAL APPLICABILITY"

Column 10, Line 12, "invention can provide" should read -- invention provides --

Column 10, Line 13, "that can solve" should read -- that solves --

Column 10, Line 15, "particles are transformed" should read
-- particles in the conventional method are transformed --

Column 10, Lines 17-18, "invention can effectively and economically form" should read
-- invention effectively and economically forms --

Column 10, Line 19, "problems of the poor porosity" should read
-- problems of poor porosity --

UNITED STATES PATENT AND TRADEMARK OFFICE

CERTIFICATE OF CORRECTION

PATENT NO. : 7,654,223 B2
APPLICATION NO. : 10/583688
DATED : February 2, 2010
INVENTOR(S) : Hyung-Jun Kim It is certified that error appears in the above-identified patent and that said Letters Patent is hereby corrected as shown below:

Title Page, Item [*]

Delete the phrase "by 483 days" and insert -- by 710 days --.

Signed and Sealed this

Twenty-fourth Day of August, 2010

David J. Kappos

David J. Kappos
*Director of the United States Patent and Trademark Office*